US008773476B2

(12) United States Patent
Tobiya

(10) Patent No.: US 8,773,476 B2
(45) Date of Patent: Jul. 8, 2014

(54) IMAGE DISPLAY SYSTEM AND IMAGE DISPLAY DEVICE

(75) Inventor: Akira Tobiya, Tokyo (JP)

(73) Assignee: NEC—Mitsubishi Electric Visual Systems Corporation, Tokyo (JP)

( * ) Notice: Subject to any disclaimer, the term of this patent is extended or adjusted under 35 U.S.C. 154(b) by 980 days.

(21) Appl. No.: 10/288,494

(22) Filed: Nov. 6, 2002

(65) Prior Publication Data

US 2003/0098874 A1 May 29, 2003

(30) Foreign Application Priority Data

Nov. 27, 2001 (JP) ..... 2001-360988

(51) Int. Cl.
*G09G 5/10* (2006.01)

(52) U.S. Cl.
USPC ..... 345/690; 345/204; 345/63; 345/77

(58) Field of Classification Search
USPC ..... 345/690, 589, 611, 619, 501, 699, 204, 345/214
See application file for complete search history.

(56) References Cited

U.S. PATENT DOCUMENTS

| | | | | |
|---|---|---|---|---|
| 5,506,942 | A * | 4/1996 | Mikuni et al. | 358/1.11 |
| 5,757,366 | A * | 5/1998 | Suzuki | 345/213 |
| 6,078,317 | A * | 6/2000 | Sawada | 345/204 |
| 6,184,861 | B1 * | 2/2001 | Callway | 345/690 |
| 6,476,821 | B2 | 11/2002 | Sawada et al. | |
| 6,563,511 | B1 * | 5/2003 | Yeh et al. | 345/611 |
| 6,731,257 | B2 * | 5/2004 | Pfeiffer et al. | 345/87 |
| 6,876,347 | B2 * | 4/2005 | Tashiro et al. | 345/87 |
| 2002/0118192 | A1 * | 8/2002 | Couckuyt et al. | 345/440 |
| 2002/0126139 | A1 * | 9/2002 | Kuriyama et al. | 345/690 |
| 2002/0175946 | A1 | 11/2002 | Sakuta et al. | |

FOREIGN PATENT DOCUMENTS

| | | | |
|---|---|---|---|
| JP | 10-326091 | A | 12/1988 |
| JP | 11-296338 | A | 10/1999 |
| JP | 11296338 | A * | 10/1999 |
| JP | 2001-13931 | A | 1/2001 |
| JP | 2002-341843 | A | 11/2002 |
| JP | 2002-341849 | A | 11/2002 |

* cited by examiner

*Primary Examiner* — Jesus Hernandez
(74) *Attorney, Agent, or Firm* — Birch, Stewart, Kolasch & Birch, LLP

(57) ABSTRACT

The present invention provides a technique for supplying appropriate image quality to a user. Upon executing an application, a PC1 outputs an automatic adjustment start signal s1 which is information relating to image quality required for the application, and on the basis of the automatic adjustment start signal s1, a display device 4 adjusts the image quality. Thus, it is possible to display an image with image quality suitable for each of the applications without causing any time-consuming manual operations by the user. Consequently, it is possible to provide appropriate image quality to the user.

2 Claims, 8 Drawing Sheets

IMAGE DISPLAY SYSTEM AND IMAGE DISPLAY DEVICE

BACKGROUND OF THE INVENTION

1. Field of the Invention

The present invention relates to an image display system for displaying an image on the basis of an image signal sent from a computer, and an image display device.

2. Description of the Background Art

FIG. 8 is a block diagram showing a configuration of a conventional image display system. As shown in FIG. 8, the conventional image display system is provided with a computer system 100 and a display device 110 connected to the computer system 100. The display device 110 has a preamplifier 120, an analog/digital converter (hereinafter, referred to as "A/D converter") 130, a microcomputer 140, a PLL (Phase Locked Loop) unit 150, a graphic controller 160 and a liquid crystal display panel 170.

The computer system 100 outputs an analog image signal composed of color signals of red (R), green (G) and blue (B) to the preamplifier 120, and outputs a horizontal synchronous signal H and a vertical synchronous signal V to the microcomputer 140. The preamplifier 120 adjusts the signal level of the received analog image signal on the basis of control of the microcomputer 140, and outputs the analog image signal having the adjusted signal level to the A/D converter 130. Hereinafter, the analog image signal to be inputted to the preamplifier 120 is referred to as "input analog image signal" and the analog image signal to be outputted from the preamplifier 120 is referred to as "output analog image signal".

The A/D converter 130 converts the received output analog image signal to a digital image signal on the basis of a sampling clock outputted from the PLL unit 150, and outputs the resulting signal to the graphic controller 160. Further, the microcomputer 140 detects and separates the horizontal synchronous signal H and vertical synchronous signal V outputted from the computer system 100, identifies the operation mode on the basis of the frequencies of the separated horizontal synchronous signal H and vertical synchronous signal V, and recognizes the resolution which corresponds to the operation mode. Moreover, the separated horizontal synchronous signal H and vertical synchronous signal V are outputted to the PLL unit 150 and the graphic controller 160.

The PLL unit 150 variably changes the sampling clock in accordance with the resolution recognized by the microcomputer 140, and outputs the resulting sampling clock to the A/D converter 130. The graphic controller 160 adjusts the frequency of the digital image signal outputted from the A/D converter 130 in accordance with the resolution recognized by the microcomputer 140, and displays an image on the liquid crystal display panel 170.

Then, an adjusting process of the signal level of an input analog image signal that is carried out in the preamplifier 120 will be described in detail. In the above-described conventional image display system, in order to appropriately carry out the gradation-display of an image, it is necessary to carry out a gradation adjustment of making the signal level of the output analog image signal coincident with the analog input range of the A/D converter 130. This gradation adjustment is carried out in the preamplifier 120. Here, the "analog input range" means a range of the analog signal level for which the A/D converter 130 can output a digital signal in accordance with the signal level of the analog signal when the A/D converter 130 converts an analog signal to a digital signal. Therefore, analog signals exceeding this range are outputted from the A/D converter 130 as digital data having a constant value regardless of the signal level.

More specifically, on the basis of the control of the microcomputer 140, the preamplifier 120 amplifies the amplitude of the input analog image signal. By varying the value of the minimum level (hereinafter, referred to as "bias value") of the input analog image signal with respect to a reference voltage, e.g., 0V, the signal level of the output analog image signal is made coincident with the analog input range of the A/D converter 130. In other words, on the basis of the control of the microcomputer 140, the preamplifier 120 adjusts the amplification rate (hereinafter, referred to as "gain value") and the bias value of the input analog image signal. The microcomputer 140 stores a program (hereinafter, referred to as "program for adjustment") used for adjusting the gain value and bias value of the input analog image signal. This program is executed by the microcomputer 140 so that the gain value and bias value of the input analog video signal are set.

Next, a setting method of the gain value and bias value of the input analog image signal in a conventional image display system will be described in more detail. FIG. 9 is a flow chart showing the setting method of the gain value and bias value of the input analog image signal in the conventional image display system. As shown in FIG. 9, at step ST100, the gain value and the bias value are initialized.

Next, at step ST110, a base address register is set, which is used for reading data of the digital image signal (hereinafter, referred to as "stable area data") corresponding to a stable area of the black area in the input analog image signal which is inputted so as to adjust the bias value. Then, at step ST120, a judgment is made as to whether or not the value of the stable area data read out through the base address register thus set is greater than the minimum value "00" of the digital output range of the A/D converter 130. Here, the "stable area" means an area which is not subjected to influences from a ringing phenomenon which tends to generate in edge portions of the input analog image signal, and is specified by a program for adjustment installed in the microcomputer 140. Moreover, the stable area data, which is read out through the base address register, is data set on a pixel basis.

As a result of the judgment at step ST120, when the value of the stable area data, which is read out through the base address, is greater than the minimum value of the digital output range of the A/D converter 130, the bias value is reduced at step ST130, and at step ST120, the judgment is again made as to whether or not the value of the stable area data read through the base address is greater than the minimum value of the digital output range of the A/D converter 130. As a result of the judgment at step ST120, when the value of the stable area data, which is read out through the base address, is equal to the minimum value "00" of the digital output range of the A/D converter 130, the adjusting process of the bias value is completed at step ST140.

Upon completion of the adjustment of the bias value, at step ST150, a base address register is set, which is used for reading the stable area data of the white area in the input analog image signal which is inputted so as to adjust the gain value. Then, at step ST160, a judgment is made as to whether or not the value of the stable area data read out through the base address register thus set is smaller than the maximum value "FF" of the digital output range of the A/D converter 130.

As a result of the judgment at step ST160, when the value of the stable area data, which is read out through the base address, is smaller than the maximum value of the digital output range of the A/D converter 130, the gain value is increased at step ST170, and at step ST160, the judgment is again made as to whether or not the value of the stable area data, which is read through the base address, is smaller than the maximum value of the digital output range of the A/D converter 130. As a result of the judgment at step ST160, when the value of the stable area data, which is read out through the base address, is equal to the maximum value of the digital output range of the A/D converter 130, the adjusting process of the gain value is completed at step ST180.

As described above, in the conventional image display system, a stable area, which is not subjected to influences from a ringing phenomenon in the input analog image signal, is used so as to set the gain value and bias value of the input analog image signal. Then, a gradation adjusting process, which makes the signal level of the output analog image signal coincident with the analog input range of the A/D converter 130, is carried out. Thus, it becomes possible to carry out an appropriate gradation displaying process.

With respect to the conventional image display system as described above, Japanese Patent Application Laid-Open No. 2001-13931 discloses substantially the same arrangement.

However, in the above-described conventional image display system, since the stable area varies depending on the computer system 100 to be connected to the display device 110, the stable area specified by the program installed in the microcomputer 140 sometimes corresponds to an area which is subjected to influences from a ringing phenomenon. In such a case, the stable area data, which is read out through the base address register, is also subjected to influences from a ringing phenomenon. In addition, the stable area data, which is read out through the base address register, is set on a pixel basis, so that processes at steps ST120 to ST140 or steps ST160 to ST180 are executed on a pixel basis. In other words, the gradation adjusting process is carried out by using stable area data corresponding to only one pixel. Therefore, depending on the computer system 100 to be connected to the display device 110, the gain value and bias value of the input analog image signal are set by using only the stable area data which has been subjected to influences from a ringing phenomenon, resulting in a failure to carry out an appropriate gradation displaying process in some cases. This makes it impossible to provide appropriate image quality to the user.

Moreover, in order to provide appropriate image quality to the user, with respect to adjustments of image quality, not only a gradation adjustment of making the signal level of the output analog image signal coincident with the analog input range of the A/D converter 130, but also adjustments on luminance and γ-characteristic need to be carried out.

SUMMARY OF THE INVENTION

It is an object of the present invention to provide a technique for supplying appropriate image quality to a user.

According to a first aspect of the present invention, an image display system includes a computer which executes application software and which outputs an image signal corresponding to the application software, and an image display device which displays an image on the basis of the image signal. Upon executing the application software, the computer outputs information relating to image quality required for the application software to the image display device. The image display device adjusts image quality on the basis of the information.

According to a second aspect of the present invention, an image display device is connected to a computer which executes application software and which outputs an image signal corresponding to the application software, and can display an image on the basis of the image signal. When the computer executes the application software, the image display device receives information relating to image quality required for the application software that is outputted from the computer, and adjusts image quality on the basis of the information.

When the image display device receives the information relating to image quality required for an application that is outputted from the computer upon executing the application, the display device adjusts image quality on the basis of the information. Thus, it is possible to display an image with image quality which is suitable for the corresponding application without causing any time-consuming, complex tasks to be carried out by the user. Consequently, it becomes possible to supply appropriate image quality to the user.

According to a third aspect of the present invention, an image display system includes a computer which outputs an analog image signal, and an image display device which displays an image on the basis of the analog image signal. The image display device has an analog/digital converter which converts the analog image signal to a digital image signal, a display unit which displays an image on the basis of the digital image signal, and a controller which carries out a gradation adjustment of making a signal level of the analog image signal and an analog input range in the analog/digital converter coincident with each other. The computer outputs the analog image signal which allows the display unit to display a predetermined pattern for use in the gradation adjustment in preset timing over a plurality of pixels, and also outputs information for instructing the start of the gradation adjustment to the controller. Upon receipt of the information, the controller makes a comparison between all the data of the digital image signal corresponding to the predetermined pattern and a value corresponding to a digital output range in the analog/digital converter, and carries out the gradation adjustment on the basis of the results of the comparison.

According to a fourth aspect of the present invention, an image display device is connected to a computer which outputs an analog image signal, and can display an image on the basis of the analog image signal. The image display device includes an analog/digital converter which converts the analog image signal to a digital image signal, a display unit which displays an image on the basis of the digital image signal, and a controller which carries out a gradation adjustment of making a signal level of the analog image signal and an analog input range in the analog/digital converter coincident with each other. The controller receives the analog image signal which allows the display unit to display a predetermined pattern for use in the gradation adjustment over a plurality of pixels in addition to information for instructing the start of the gradation adjustment that is outputted from the computer in preset timing, and makes a comparison between all the data of the digital image signal corresponding to the predetermined pattern and a value corresponding to a digital output range in the analog/digital converter, and carries out the gradation adjustment on the basis of the results of the comparison.

The controller receives information for instructing the start of the gradation adjustment that is outputted from the computer in preset timing, and carries out a gradation adjustment of making a signal level of the analog image signal and an analog input range in the analog/digital converter coincident with each other. Therefore, it is possible to carry out an appropriate gradation displaying process without requiring any specific attention of the user, in other words, without requiring any time-consuming, complex manual operations by the user. Consequently, it is possible to supply appropriate image quality to the user without requiring any time-consuming, complex manual operations by the user.

These and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
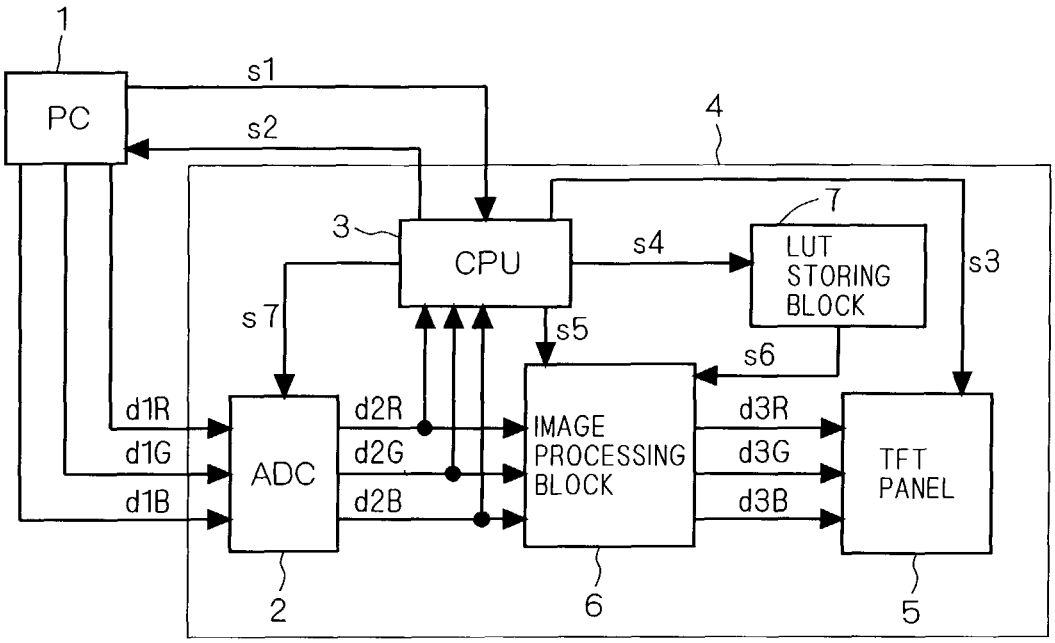
FIG. 1 is a block diagram showing a configuration of an image display system according to a first embodiment of the present invention.

FIG. 1 is a block diagram showing a configuration of an image display system according to a first embodiment of the present invention, and this also serves as a block diagram showing a configuration of an image display system according to a second embodiment, which will be described later. As shown in FIG. 1, the image display system according to the first embodiment is provided with: a personal computer (hereinafter, referred to as "PC") 1 which executes a plurality of pieces of application software (hereinafter, simply referred to as "application") and outputs analog image signals d1R, d1G and d1B that correspond to the respective applications; and an image display device 4 (hereinafter, simply referred to as "display device 4") which displays an image on the basis of the analog image signals d1R, d1G and d1B. Here, the analog image signals d1R, d1G and d1B outputted by the PC1, are color signals corresponding to red (R), green (G) and blue (B) in this order, and these analog image signals d1R, d1G and d1B are collectively referred to as "analog image signal d1" in some cases. Moreover, the PC1 outputs an automatic adjustment start signal s1 which is information relating to image quality individually required in each of the applications to be executed, to the display device 4 by using DDC (Display Data Channel) commands, for example.

The display device 4 has: an analog/digital converter 2 (hereinafter, referred to as "ADC2") which respectively converts the analog image signals d1R, d1G and d1B to digital image signals d2R, d2G and d2B at a resolution of, for example, 8 bits; a CPU (Central Processing Unit) 3 which controls other blocks in the display device 4, communicates with the PC1, and outputs an automatic adjustment completion signal s2 indicating that the adjustment of the image quality has been completed; an image processing block 6 which carries out predetermined data conversions on the respective digital image signals d2R, d2G and d2B and outputs the resulting signals as digital image signals d3R, d3G and d3B; a TFT (Thin Film Transistor) panel 5 which is a display unit for displaying an image on the basis of the digital image signals d3R, d3G and d3B; and an LUT storing block 7 which stores a plurality of look-up tables used for γ-characteristic conversion. Here, the digital image signals d2R and d3R are red color signals, the digital signals d2G and d3G are green color signals, and digital image signals d2B and d3B are blue color signals. Hereinafter, in some cases, the digital image signals d2R, d2G and d2B are collectively referred to as "digital image signal d2", and the digital image signals d3R, d3G and d3B are collectively referred to as "digital image signal d3". Moreover, the CPU3 outputs a gradation adjusting signal s7 to the ADC2. However, this gradation adjusting signal s7 is not used in the image display system according to the first embodiment, but used in the image display system according to the second embodiment, which will be described later. Therefore, none of description therefor will be given.

Figure 2:
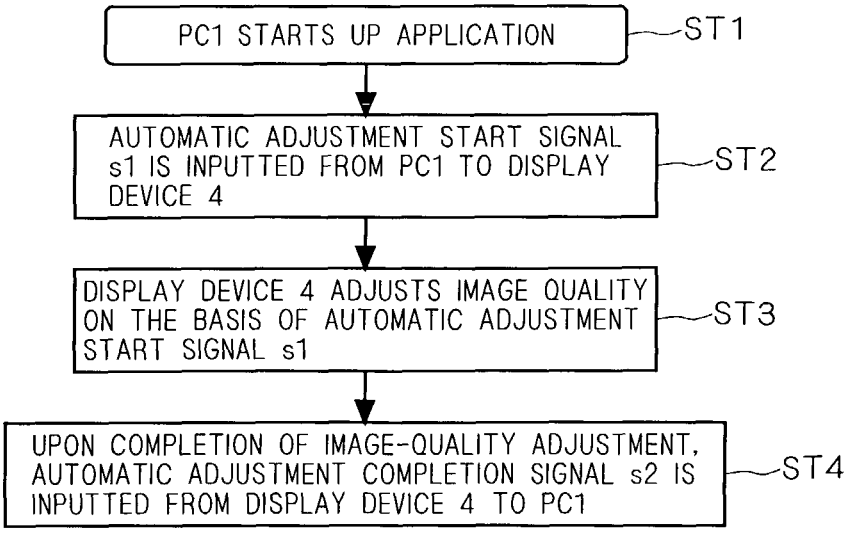
FIG. 2 is a flow chart showing an adjusting method of image quality in the image display system according to the first embodiment of the present invention.

FIG. 2 is a flow chart showing an adjusting method of image quality in the image display system according to the first embodiment. As shown in FIG. 2, at step ST1, when the user sends an instruction for executing a desired application to the PC1, the PC1 starts up the corresponding application, and inputs an analog image signal d1 corresponding to the application to the ADC2 of the display device 4. Then, at step ST2, the PC1 inputs the automatic adjustment start signal s1 to the display device 4, and more specifically to the CPU3. Here, the automatic adjustment start signal s1 contains adjustment items of image quality required in the application to be executed by the PC1 and adjustment values in the respective adjustment items, and the adjustment items include, for example, luminance, γ-characteristic, contrast and the like.

Further, at step ST3, the display device 4 adjusts the image quality on the basis of the automatic adjustment start signal s1. More specifically, upon receipt of the automatic adjustment start signal s1, the CPU3 controls the other blocks within the display device 4 so that the image quality is adjusted in accordance with the adjustment items and adjustment values contained in the automatic adjustment start signal s1. Upon completion of the adjustment of the image quality in the display device 4, at step ST4, the automatic adjustment completion signal s2 is inputted from the display device 4, and more specifically from the CPU3 to the PC1 so that the PC1 recognizes that the image quality adjustment has been completed within the display device 4. Here, a driver, which forms basic software relating to communications between the PC1 and the CPU3 in the display device 4, is preliminarily installed in the PC1. Moreover, items relating to adjustment functions are different depending on display devices 4 to be used, for example, in some cases, some display devices 4 have adjustment functions for γ-characteristic, while the other display devices 4 have no adjustment functions for γ-characteristic; therefore, the above-described driver is prepared for each of the display devices 4, with the items of the adjustment functions that the display device 4 has and the controlling parameters required for the adjustments being stored in the driver.

Next, referring to examples about adjustment items of image quality contained in the automatic adjustment start signal s1, an adjusting method of image quality will be more specifically described. As one example of applications in which the gradation control is significant, an application using "Clear Type", which is a smoothing technique of vector font which is one type of the data system of character font, has been proposed. The "Clear Type" is a technique in which respective cells of red (R), green (G) and blue (B) that constitute one pixel of a color liquid crystal display are independently controlled so as to smooth edges of vector font. When the PC1 executes the application using the "Clear Type", coloring in rainbow colors occurs in character edge portions unless the γ-characteristic of the display device 4 is set to a γ value=2.2 for each of the respective color signals of RGB, resulting in a failure to sufficiently obtain the effects of "Clear Type". For this reason, the specification of γ value=2.2 is required for the display device 4.

In the image display system according to the first embodiment, the γ-characteristic can be adjusted by using, for example, a look-up table, and when the PC1 executes an application using the "Clear Type", the γ-characteristic is adjusted so as to be set to the γ value=2.2. More specifically, when the PC1 starts up an application using "Clear Type" (step ST1), the automatic adjustment start signal s1 containing information that "the γ-characteristic is adjusted so as to be set to the γ value=2.2" is inputted from the PC1 to the CPU3 of the display device 4 (step ST2). Then, the CPU3 outputs a LUT switching signal s4 to the LUT storing block 7 so that an instruction is given to the LUT storing block 7 so as to set the look-up table corresponding to the γ value=2.2 in the image processing block 6. Upon receipt of the LUT switching signal s4, the LUT storing block 7, which stores look-up tables corresponding to respective γ values, sets the look-up table corresponding to the γ value=2.2 in the image processing block 6. Then, the image processing block 6 carries out a data conversion process on the digital image signal d2 in accordance with the look-up table which has been set, adjusts the γ-characteristic to the γ value=2.2, and outputs the digital image signal d3 to the TFT panel 5 (step ST3). The TFT panel 5 displays an image on the basis of the digital image signal d3. Upon completion of the adjustment of the γ characteristic, the CPU3 inputs an automatic adjustment completion signal s2 to the PC1 (step ST4). Here, no adjusting functions of the γ characteristic are prepared depending on the display device 4 to be used. However, since the presence or absence of the adjusting functions of the γ-characteristic has been written in the driver that has been preliminarily installed, the automatic adjustment start signal s1 is not inputted to the display device 4 when such a display device 4 is used. It is noted that the same is true for the other adjustment items for image quality such as luminance and white balance, and in the case when the display device 4 has no adjusting functions of the respective adjustment items, the automatic adjustment start signal s1 is not inputted to the display device 4.

Next, the following description will be given of adjustments of image quality in the case where the application to be executed by the PC1 is word processor software. In recent years, most of word processors form documents with black characters on the white background. In this case, when the luminance setting of the display device 4 is too high, eyestrain tends to occur, resulting in degradation in the work efficiency. In the image display system according to the first embodiment, when the PC1 executes a piece of word processing software, an adjustment can be carried out so as to set the luminance of the display device 4 to a lower level. More specifically, when the PC1 starts up a piece of word processing software (step ST1), the automatic adjustment start signal s1 containing information that "the luminance is set to a low level" is inputted from the PC1 to the CPU3 of the display device 4 (step ST2). Then, the CPU3 outputs a luminance controlling signal s3 to the TFT panel 5 so that an instruction is given to the TFT panel 5 so as to lower the luminance setting value. Upon receipt of the luminance controlling signal s3, the TFT panel 5, which has, for example, a fluorescent tube, controls an inverter circuit for driving the fluorescent tube so as to lower the luminance (step ST3). Upon completion of the adjustment of the luminance, the CPU3 inputs an automatic adjustment completion signal s2 to the PC1 (step ST4). Moreover, in the case where the word processor software uses "Clear Type", the automatic adjustment start signal s1 also contains the information that "the γ-characteristic is adjusted so as to be set to the γvalue=2.2", and the γ-characteristic is also adjusted as described above.

Moreover, in the last few years, PCs have been rapidly applied to multimedia, and video streaming, DVDs (Digital Versatile Disks) and the like have come to be widely used; thus, there have been more opportunities to reproduce moving pictures by using a PC. Normally, when moving pictures are viewed, brighter display is preferably used in a manner opposite to the application of the word processor software. In the image display system according to the first embodiment, when the PC1 executes an application used for reproducing moving pictures, an adjustment can be made so as to increase the luminance setting of the display device 4. More specifically, when the PC1 starts up an application used for reproducing moving pictures (step ST1), the automatic adjustment start signal s1 containing information that "the luminance is adjusted so as to be set to a higher level" is inputted from the PC1 to the CPU3 of the display device 4 (step ST2). Then, the CPU3 outputs a luminance controlling signal s3 to the TFT panel 5 so that an instruction is given to the TFT panel 5 so as to set the luminance setting value higher. Upon receipt of the luminance controlling signal s3, the TFT panel 5 controls an inverter circuit for driving the fluorescent tube so as to increase the luminance (step ST3). Upon completion of the adjustment of the luminance, the CPU3 inputs an automatic adjustment completion signal s2 to the PC1 (step ST4).

Moreover, in the image display system according to the first embodiment, when the PC1 executes an application in which a white-balance adjustment is required, the white-balance adjustment can be carried out in the display device 4. More specifically, when the PC1 starts up an application in which a white-balance adjustment is required (step ST1), the automatic adjustment start signal s1 containing information that "the white-balance is adjusted" is inputted from the PC1 to the CPU3 of the display device 4 (step ST2). Then, the CPU3 outputs a white-balance controlling signal s5 to the image processing block 6 so that an instruction is given to the image processing block 6 so as to adjust the white balance. Upon receipt of the white-balance controlling signal s5, the image processing block 6 carries out a data conversion process on the digital image signal d2 in accordance with the contents the signal so that the white-balance is adjusted and the resulting digital image signal d3 is outputted to the TFT panel 5 (step ST3). The TFT panel 5 displays an image on the basis of the digital image signal d3. Upon completion of the adjustment of the white-balance, the CPU3 inputs an automatic adjustment completion signal s2 to the PC1 (step ST4).

As described above, in the image display system according to the first embodiment, when the display device 4 receives the automatic adjustment start signal s1 which is outputted by the PC1 upon executing an application and which includes information relating to image quality required for the application, the display device 4 adjusts the image quality on the basis of the automatic adjustment start signal s1. Therefore, it becomes possible to display an image with image quality which is suitable for the corresponding application without causing any time-consuming, complex tasks to be carried out by the user. As a result it becomes possible to supply appropriate image quality to the user.

It is noted that, in the first embodiment, an analog interface is adopted as the image signal input interface of the display device 4. However, the present invention is also applicable to a case where a display device 4 using a digital interface or a digital/analog compatible interface is adopted. Also in the display device 4 using the digital interface, a digital signal receiver is adopted in place of the ADC2. Moreover, in the display device 4 using the digital/analog compatible interface, both of the ADC2 and the digital signal receiver are adopted, and a circuit which switches the ADC2 and the digital signal receiver depending on the kinds of the inputted image signal is also provided.

Moreover, in the first embodiment, the automatic adjustment start signal s1 is sent to the display device 4 through DDC commands. However, the automatic adjustment start signal s1 may be sent to the display device 4 by using another interface standard, such as RS-232C.

In addition, in the first embodiment, the TFT panel 5 is used as a display unit for displaying images. However, another display unit, such as a plasma display panel, may be used.

Second Embodiment

Next, referring again to FIG. 1, an image display system according to the second embodiment will be described. In the image display system according to the second embodiment, the analog input range of the ADC2 is further adjusted by using a gradation adjusting signal s7 which is not used in the image display system according to the above-described first embodiment. As described above, in order to gradation-display an image appropriately, a gradation-adjusting process for matching the signal level of the analog image signal d1 with the analog input range of the ADC2 is required. In the second embodiment, this gradation adjustment is carried out by changing the analog input range of the ADC2. Here, the other configurations are the same as those of the image display system according to the above-described first embodiment, Therefore, none of description therefor will be given.

Figure 3A:
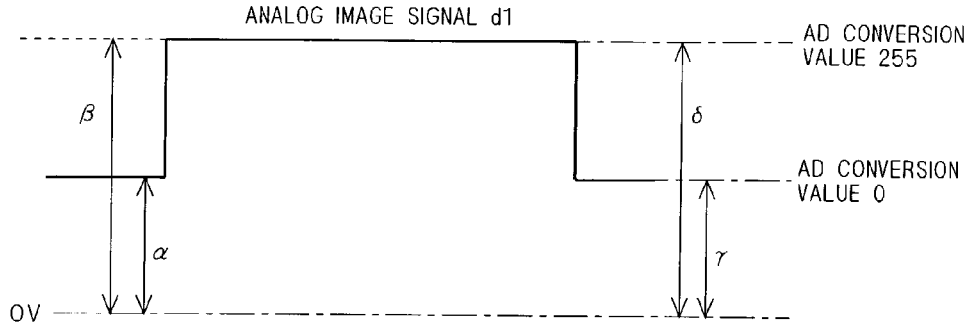
FIGS. 3A, 3B and 3C show the relationship between the signal level of an analog image signal d1 and the analog input range of an ADC2.
Figure 3B:
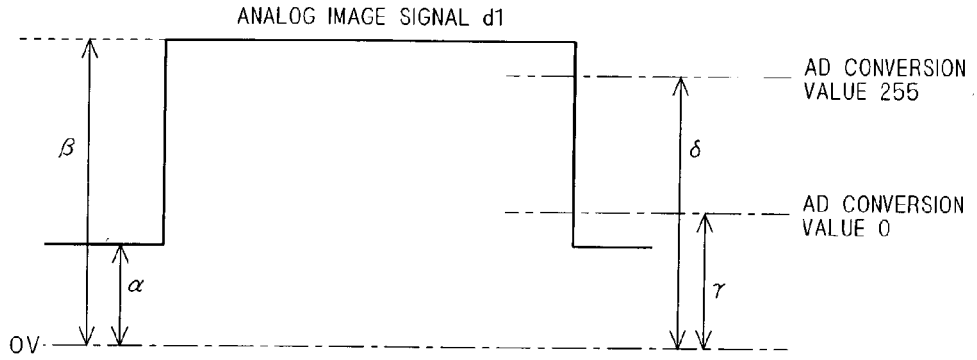
Figure 3C:
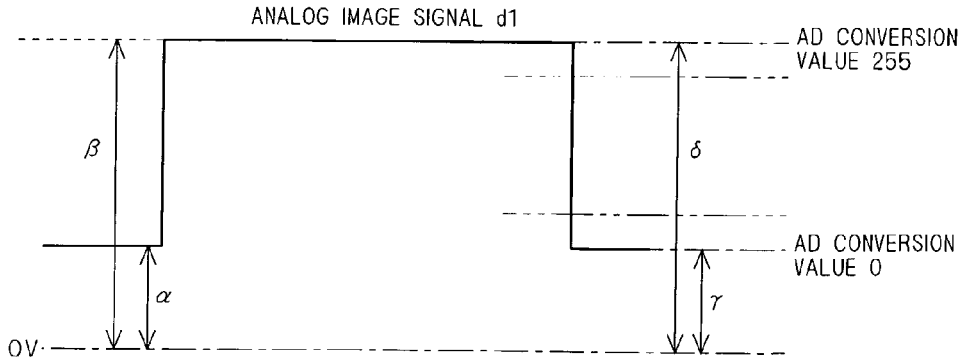

FIGS. 3A, 3B and 3C show the relationship between the signal level of the analog image signal d1 and the analog input range of the ADC2. FIG. 3A shows a case where the signal level of the analog image signal d1 is coincident with the analog input range of the ADC2. FIG. 3B shows a case where the signal level of the analog image signal d1 is not coincident with the analog input range of the ADC2. FIG. 3C shows a case where the signal level of the analog image signal d1 and the analog input range of the ADC2, which have been set to a relationship shown in FIG. 3B, are made coincident with each other by adjusting the analog input range of the ADC2. Here, the respective values shown in FIGS. 3A, 3B and 3C are indicated relative to 0V, for convenience of description.

As shown in FIG. 3A, in the case where the minimum value $\alpha$ of the signal level of the analog image signal d1 is coincident with the minimum value $\gamma$ of the analog input range of the ADC2 and where the maximum value $\beta$ of the signal level of the analog image signal d1 is coincident with the maximum value $\delta$ of the analog input range of the ADC2, the analog image signal d1 can be converted to a digital image signal d2 appropriately at a resolution of 8 bits in the ADC2. Therefore, it is possible to gradation-display an image appropriately. However, depending on the PC1 to be connected to the display device 4 as well as depending on time-based changes in the same PC1, the amplitude of the analog image signal d1 tends to become greater. Consequently, as shown in FIG. 3B, there sometimes is a case where the minimum value $\alpha$ of the signal level of the analog image signal d1 becomes smaller than the minimum value $\gamma$ of the analog input range of the ADC2 and the maximum value $\beta$ of the signal level of the analog image signal d1 becomes greater than the maximum value $\delta$ of the analog input range of the ADC2. In such a case, all the analog image signal d1 smaller than the minimum value $\gamma$ of the analog input range of the ADC2 is converted to data "0" (represented by decimal value) by the ADC2. In other words, the data of the digital image signal d2 corresponding to such an analog image signal d1 is represented by "0" in the decimal system. Moreover, all the analog image signal d1 greater than the maximum value $\delta$ of the analog input range of the ADC2 is converted to data "255" (represented by decimal value) by the ADC2. In other words, the data of the digital image signal d2 corresponding to such an analog image signal d1 is represented by "255" in the decimal system. Consequently, it becomes impossible to gradation-display an image appropriately.

In the second embodiment as shown in FIG. 3C, even when the signal level of the analog image signal d1 is varied, the signal level of the analog image signal d1 and the analog input range of the ADC2 are made coincident with each other by adjusting the analog input range of the ADC2.

Figure 4:
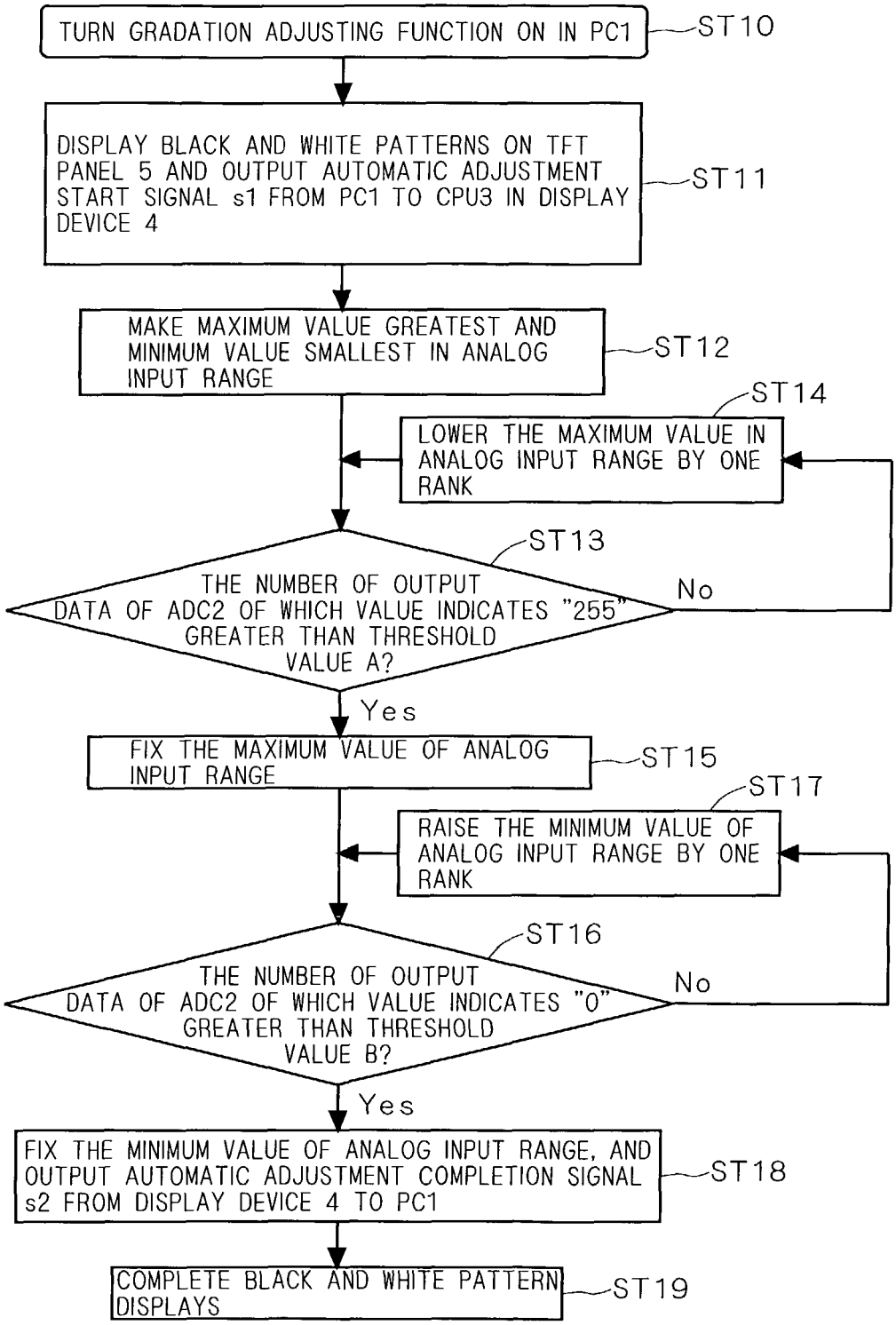
FIG. 4 is a flow chart showing a gradation adjusting method in an image display system according to a second embodiment of the present invention.

Next, the detailed description will be given of the gradation adjustment carried out by the image display system according to the second embodiment. FIG. 4 is a flow chart showing the gradation adjusting method in the image display system according to the second embodiment. In the image display system according to the second embodiment, for example, upon activating the OS (Operating Systems) of the PC1, a gradation adjustment is carried out. As shown in FIG. 4, at step ST10, the PC1 turns the gradation adjusting function on upon activating the OS. When the gradation adjusting function is operated, the PC1 displays predetermined patterns for gradation adjustment (hereinafter, referred to as "pattern for gradation adjustment"), for example, a black pattern and a white pattern that respectively cover a plurality of pixels, on the TFT panel 5 at step ST11, and also outputs an automatic adjustment start signal s1 to the CPU3 of the display device 4. Here, in the second embodiment, the black pattern and the white pattern are respectively displayed in a manner so as to cover a plurality of pixels. These pixels constitute, for example, one line of horizontal lines in the display screen of the TFT panel 5. In other words, the black pattern and the white pattern are simultaneously displayed on respective horizontal lines in the display screen. Moreover, the automatic adjustment start signal s1 according to the second embodiment is a signal which further contains information for giving an instruction so as to start the gradation adjustment to the CPU3, and also contains information relating to image quality individually required for the respective applications as described in the first embodiment when the PC1 carries out the application, so that the image display system according to the second embodiment carries out an adjustment on the image quality which is suitable for each of the applications.

The operation at step ST11 will be further described. When the gradation adjusting function is turned on, the PC1 outputs an analog image signal d1 which, allows the TFT panel 5 to display patterns for gradation adjustment over a plurality of pixels, to the ADC2 of the display device 4, and also outputs the automatic adjustment start signal s1 to the CPU3 of the display device 4. Then, the ADC2 converts the inputted analog image signal d1 for displaying the pattern for gradation adjustment to a digital image signal d2, and outputs the resulting signal. Further, the image processing block 6 carries out a predetermined data conversion on the digital image signal d2, and outputs the resulting signal to the TFT panel 5 as a digital image signal d3. On the basis of the digital image signal d3 thus received, the TFT panel 5 displays the patterns for gradation adjustment. In other words, each of the black pattern and the white pattern is simultaneously displayed as a single line. Therefore, the analog image signal d1 is allowed to have a minimum amplitude value and a maximum amplitude value within one frame period. In other words, the signal level of the analog image signal d1 is allowed to have the minimum value and the maximum value within one frame period. Here, on the assumption that the image processing block 6 is included in the TFT panel 5, the TFT panel 5 displays the black pattern and the white pattern on the basis of the digital image signal d2.

Upon receipt of the automatic adjustment start signal s1, the CPU3 starts an adjusting process with respect to the analog input range of the ADC2. More specifically, the maximum value and the minimum value in the analog input range of the AD2 are set to various values by altering the reference voltage which specifies the analog input range and is given to the ADC2. At step ST12, the CPU3 outputs a gradation adjusting signal s7 to the ADC2 so that the maximum value in the analog input range of the ADC2 is set to the greatest value while the minimum value therein is set to the smallest value. Then, at step ST13, the CPU3 monitors the data of the digital image signal d2 outputted from the ADC2 on a pixel basis during one frame period, and the data corresponding to one frame of the digital image signal d2 thus monitored is compared with the maximum value in the digital output range of the ADC2. Here, since the patterns for gradation adjustment are displayed on the display screen of the TFT panel 5, comparing the data corresponding to one frame of the monitored digital image signal d2 with the maximum value in the digital output range of the ADC2 is consequently equivalent to comparing all the data of the digital image signal d2 corresponding to the patterns for gradation adjustment with the maximum value in the digital output range of the ADC2. It is noted that, in the second embodiment, since the resolution of the ADC2 is set to 8 bits, the maximum value in the digital output range is set to "255" in the decimal system.

Then, as a result of the comparison at step ST13, of the data corresponding to one frame of the monitored digital image signal d2, when the number of data having the value of "255" is not more than a predetermined threshold value A, the CPU3 sends the gradation adjusting signal s7 to the ADC2 at step ST14 so as to lower the maximum value in the analog input range of the ADC2 by one rank. Then, the above-described step ST13 is executed, and of the data corresponding to one frame of the monitored digital image signal d2, when the number of data having the value of "255" is greater than the predetermined threshold value A, the CPU3 fixes the maximum value in the analog input range of the ADC2 at that time at step ST15; thus, the adjustment of the maximum value in the analog input range in the ADC2 is completed.

Next, at step ST16, the CPU3 monitors the data of the digital image signal d2 outputted from the ADC2 on a pixel basis during one frame period, and the data corresponding to one frame of the digital image signal d2 thus monitored is compared with the minimum value in the digital output range of the ADC2. Here, comparing the data corresponding to one frame of the monitored digital image signal d2 with the minimum value in the digital output range of the ADC2 is consequently equivalent to comparing all the data of the digital image signal d2 corresponding to the patterns for gradation adjustment with the minimum value in the digital output range of the ADC2. It is noted that, in the second embodiment, since the resolution of the ADC2 is set to 8 bits, the maximum value in the digital output range is set to "0" in the decimal system.

Then, as a result of the comparison at step ST16, of the data corresponding to one frame of the monitored digital image signal d2, when the number of data having the value of "0" is not more than a predetermined threshold value B, the CPU3 sends the gradation adjusting signal s7 to the ADC2 at step ST17 so as to raise the minimum value in the analog input range of the ADC2 by one rank. Then, the above-described step ST16 is executed, and of the data corresponding to one frame of the monitored digital image signal d2, when the number of data having the value of "0" is greater than the predetermined threshold value B, the CPU3 fixes the minimum value in the analog input range of the ADC2 at that time at step S19; thus, the gradation adjustment in the display device 4 is completed. Further, the CPU3 outputs an automatic adjustment completion signal s2 to the PC1. In this case, the gradation adjustment is one type of the image quality adjusting processes, and the automatic adjustment completion signal s2, which is information indicating the completion of the image quality adjustment, contains information indicating the completion of the gradation adjustment. Upon receipt of the automatic adjustment completion signal s2, the PC1 recognizes that the gradation adjustment has been completed in the display device 4, and finishes the display of the patterns for gradation adjustment. More specifically, the PC1 stops the output of the analog image signal d1 which displays the patterns for gradation adjustment.

Figure 5:
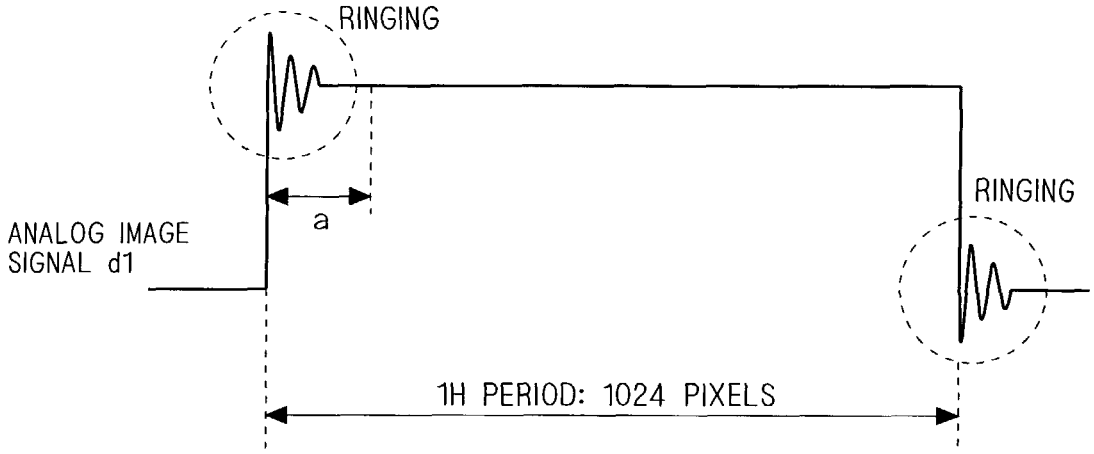
FIG. 5 is shows a state where a ringing phenomenon generates in the analog image signal d1.

Next, the brief description will be given of a setting method of the above-described threshold values A, B. The resolution of the TFT panel 5 according to the second embodiment is determined on the basis of, for example, XGA (Extended Graphics Array), and capable of displaying 1024×768 dots. In such a TFT panel 5, the number of display pixels in the 1H period is 1024 pixels. In the second embodiment, each of the black pattern and the white pattern is displayed on one line of horizontal lines. Therefore, the number of data of the digital image signal d2 corresponding to the black pattern is set to 1024, and the number of data of the digital image signal d2 corresponding to the white pattern is also set to 1024. Here, taking into consideration that, supposing that the number of display pixels which are under influences of a ringing phenomenon is "a" as shown in FIG. 5, the number of display pixels that are under the ringing phenomenon tends to vary due to the PC1 connected thereto, and that noise tends to generate in the analog image signal d1 in addition to the ringing phenomenon, the threshold values A and B are set to, for example, "1024−2a". In this manner, the threshold values A and B are appropriately set so that, even when the analog image signal d1 is under the influence of the ringing phenomenon or even when the analog image signal d1 is under influence from noise other than the ringing phenomenon, the analog input range of the ADC2 can be adjusted without having influences from these. Consequently, the gradation adjustment can be carried out appropriately. Here, with respect to the above-described number of display pixels "a", it can be set by, for example, experiments.

The gradation adjustment is carried out as described above so that the signal level of the analog image signal d1 is made coincident with the analog input range of the ADC2. Thus, it is possible to carry out an appropriate gradation display on an image. Consequently, it becomes possible to supply appropriate image quality to the user.

Moreover, in the second embodiment, the gradation adjustment is carried out by using the results of comparison between the data of the digital image signal d2 corresponding to the pattern for gradation adjustment containing the black pattern and the minimum value of the digital output range of the ADC2. Therefore, the minimum value of the signal level of the analog image signal d1 is positively made coincident with the minimum value of the analog input range of the ADC2. Furthermore, the gradation adjustment is carried out by using the results of comparison between the data of the digital image signal corresponding to the pattern for gradation adjustment containing the white pattern and the maximum value of the digital output range of the analog/digital converter. Therefore, the maximum value of the signal level of the analog image signal d1 is positively made coincident with the maximum value of the analog input range of the ADC2. As a result, it becomes possible to make the signal level of the analog image signal d1 and the analog input range in the ADC2 almost coincident with each other, and consequently to carry out an appropriate gradation display on an image.

Moreover, in accordance with the image display system according to the second embodiment, the CPU3 receives the automatic adjustment start signal s1 which is outputted from the PC1 in predetermined timing, more specifically, upon activation of the OS, and carries out the gradation adjustment. Therefore, it is possible to carry out an appropriate gradation display without requiring any specific attention of the user, that is, without requiring any time-consuming, complex manual operations by the user, and consequently to supply appropriate image quality to the user without requiring any time-consuming manual operations by the user.

Moreover, in accordance with the image display system according to the second embodiment, comparison is made between all the data of the digital image signal d2 corresponding to the patterns for gradation adjustment displayed over a plurality of pixels and the value corresponding to the digital output range in the ADC2, and on the basis of the results of the comparison, a gradation adjusting process is carried out. In other words, the data of the digital image signal d2 corresponding to a plurality of pixels is used to carry out the gradation adjusting process. Consequently, for example, the operations from step ST13 to step ST17 are carried out. In contrast, in the above-described conventional technique, the gradation adjustment is carried out by using only the data of a digital image signal corresponding to one pixel, with the result that it is not possible to carry out the operations from step ST13 to step ST17. For this reason, in the case where a ringing phenomenon occurs over several pixels as shown in FIG. 5, it is not possible to carry out a gradation adjustment without receiving the resulting adverse effects. In the image display system according to the second embodiment, for example, by executing the operations from the above-described step ST13 to step ST17, it is possible to carry out a gradation adjustment without receiving the resulting adverse effects even when noise such as a ringing phenomenon occurs over several pixels.

Moreover, in accordance with the second embodiment, after the gradation adjustment is completed by the CPU3, the display of the pattern for gradation adjustment is completed. Therefore, patterns that are not required for the user become less conspicuous in comparison with cases where the pattern for gradation adjustment is always displayed.

Furthermore, during the gradation adjusting process, since the pattern for gradation adjustment is partially displayed on the display screen of the TFT panel 5, more specifically, since only one line of each of the black pattern and the white pattern is displayed on the display screen, patterns that are not required for the user become less conspicuous in comparison with cases where the pattern for gradation adjustment is displayed over the entire surface of the display screen.

Third Embodiment

Figure 6:
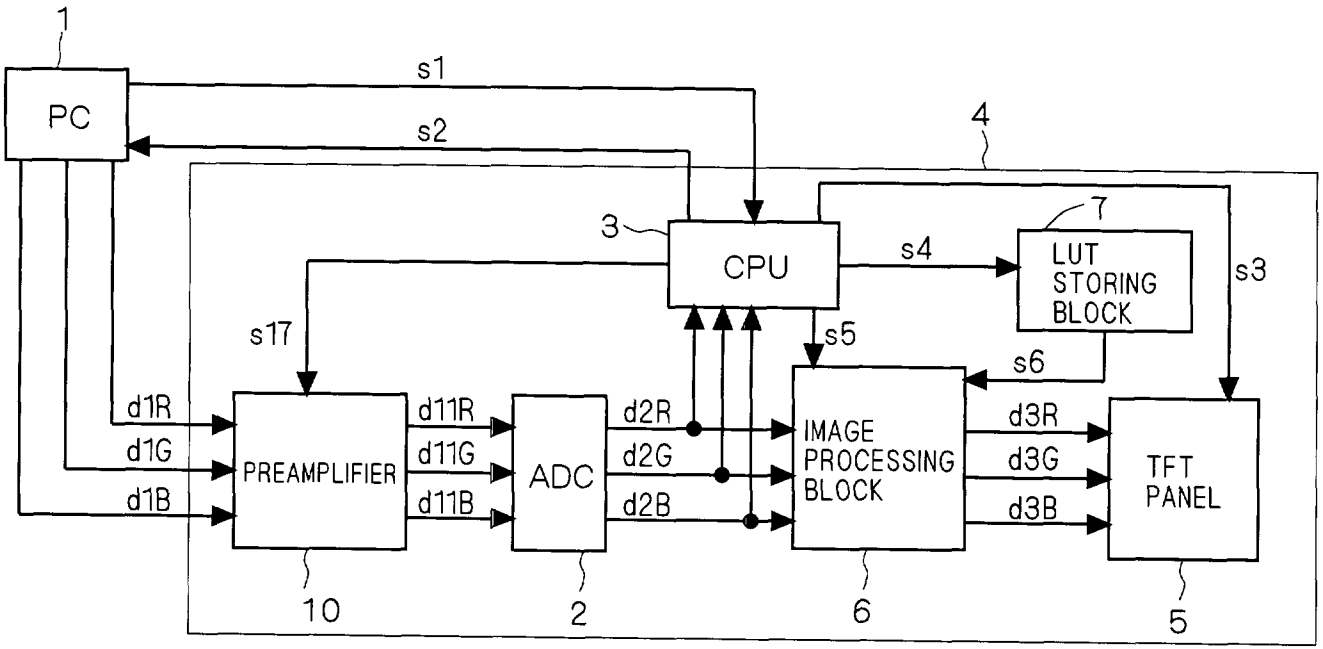
FIG. 6 is a block diagram showing a configuration of an image display system according to a third embodiment of the present invention.

FIG. 6 is a block diagram showing a configuration of an image display system according to a third embodiment. In the image display system according to the above-described second embodiment, the gradation adjustment is carried out by changing the analog input range of the ADC2. However, in the image display system according to the third embodiment, the gradation adjustment is carried out by changing the signal level of the analog image signal d1. With respect to the configuration thereof, a preamplifier 10 is further provided to the image display system according to the first embodiment, and in place of the gradation adjusting signal s7 outputted to the ADC2, the CPU3 outputs a gradation adjusting signal s17 to the preamplifier 10 so that a gradation adjusting process is carried out by changing the signal level of the analog image signal d1.

As shown in FIG. 6, the analog image signal d1, which is outputted from the PC1, is inputted to the preamplifier 10, and the preamplifier 10 is controlled by the CPU3 to change the signal level of the analog image signal d1. More specifically, as shown in FIG. 3B, when the signal level of the analog image signal d1 is changed, the gain value and bias value of the analog image signal d1 are adjusted so that the signal level of the analog image signal d11 is made coincident with the analog input range of the ADC2. Then, the analog image signal d1 with its signal level being changed is outputted to the ADC2 as analog image signals d11R, d11G and d11B. Here, the analog image signals d11R, d11G and d11B are color signals of red, green and blue, in this order, and hereinafter, the analog image signals d11R, d11G and d11B are collectively referred to as "analog image signals d11". The ADC2 converts the analog image signal d11 to a digital image signal d2. Since the other configurations are the same as those of the image display system according to the first embodiment, none of description therefor will be given.

Figure 7:
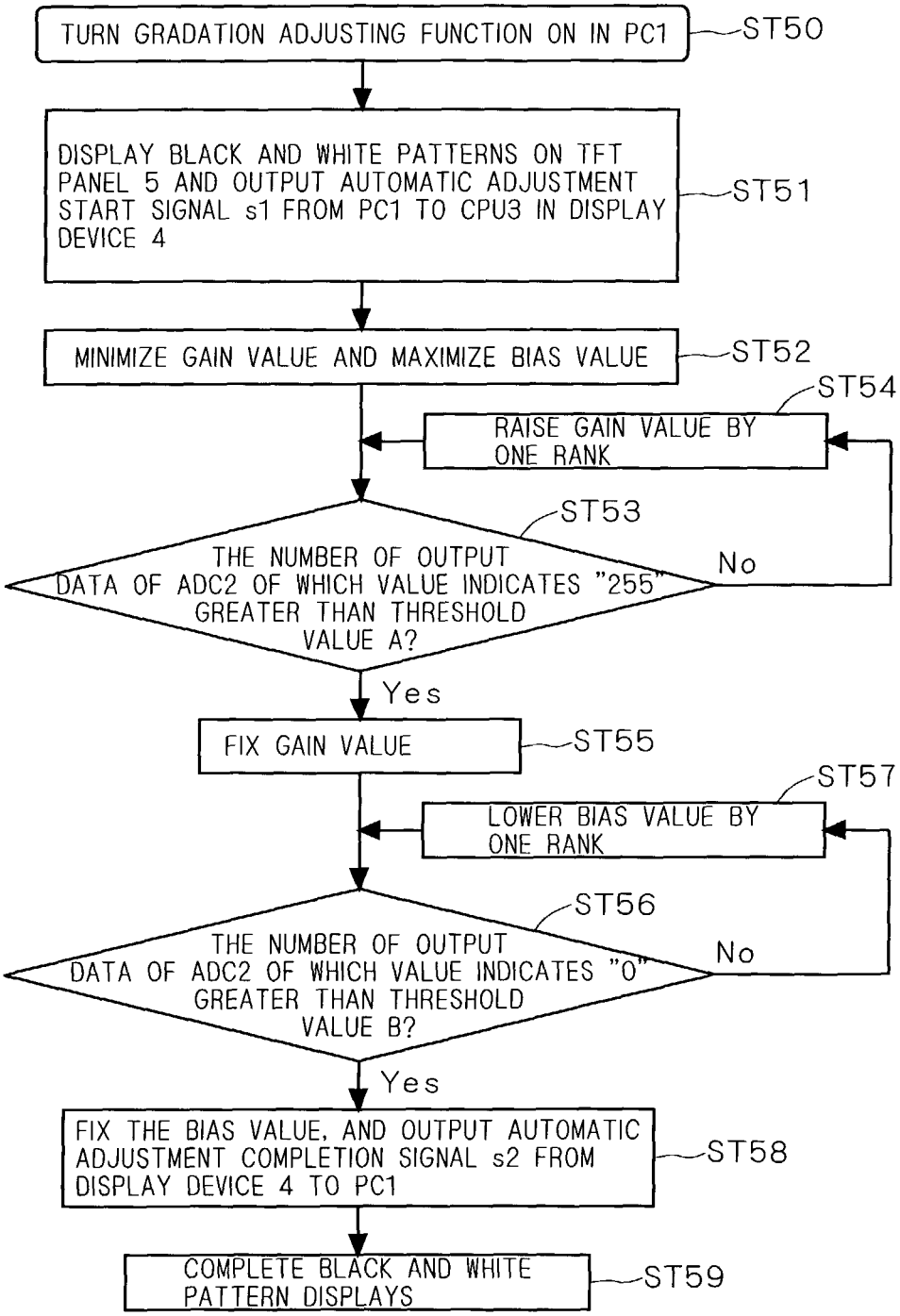
FIG. 7 is a flow chart showing a gradation adjusting method in an image display system according to the third embodiment of the present invention.
Figure 8:
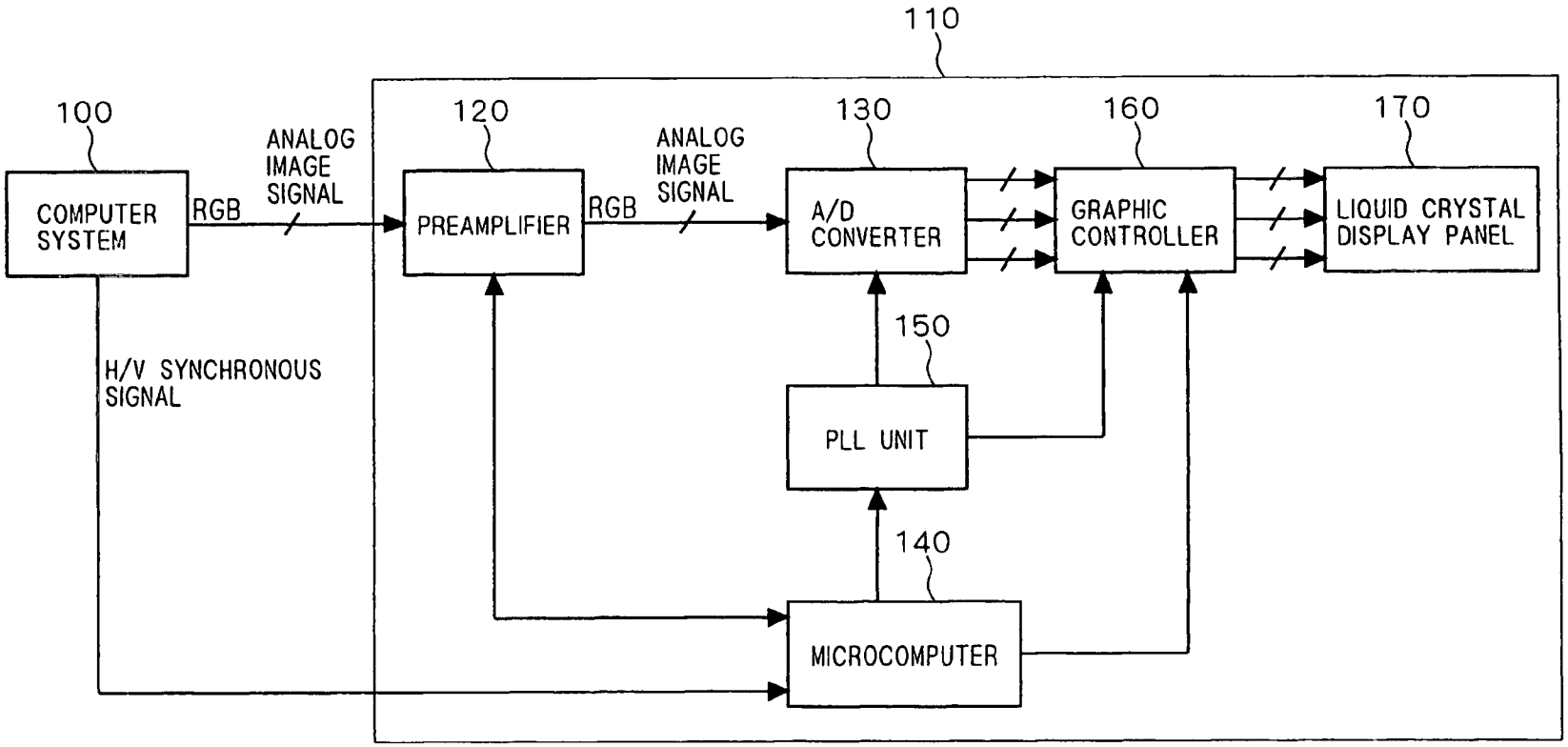
FIG. 8 PRIOR ART
FIG. 8 is a block diagram showing a configuration of a conventional image display system.
Figure 9:
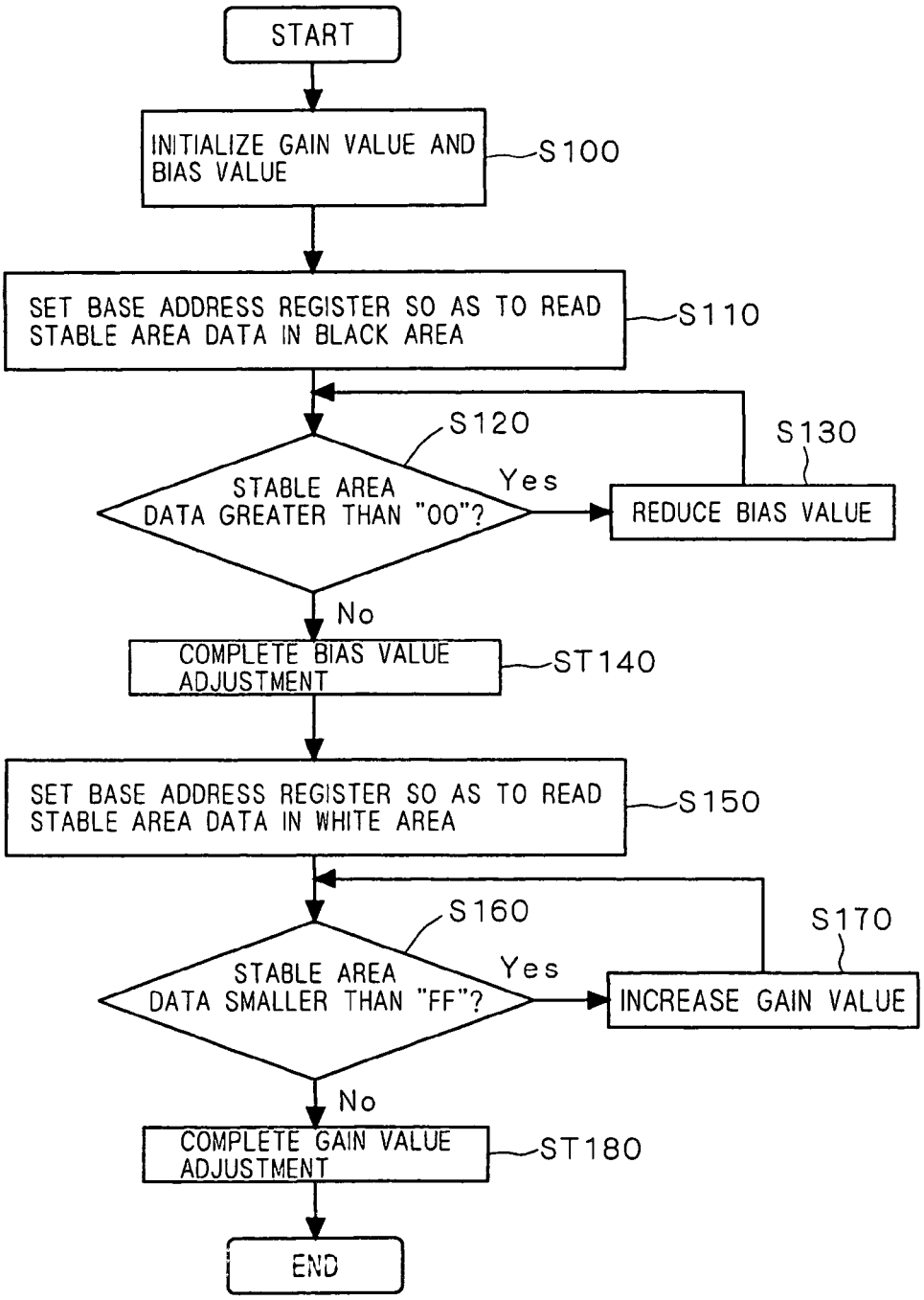
FIG. 9 PRIOR ART
FIG. 9 is a flow chart showing a setting method of a gain value and a bias value of an input analog image signal in the conventional image display system.

Next, the detailed description will be given of gradation adjustments carried out by the image display system according to the third embodiment. FIG. 7 is a flow chart showing the gradation adjusting method in the image display system according to the third embodiment. In the image display system according to the third embodiment, for example, upon activating the OS of the PC1, a gradation adjustment is carried out. As shown in FIG. 7, at step ST50, the PC1 turns the gradation adjusting function on upon activating the OS. When the gradation adjusting function is operated, the PC1 displays predetermined patterns for gradation adjustment, for example, a black pattern and a white pattern that respectively cover a plurality of pixels, on the TFT panel 5 at step ST51, and also outputs an automatic adjustment start signal s1 to the CPU3 of the display device 4. Here, in the third embodiment, the black pattern and the white pattern are respectively displayed in a manner so as to cover a plurality of pixels. However, these pixels constitute, for example, one line of horizontal lines in the display screen of the TFT panel 5. In other words, each of the black pattern and the white pattern is simultaneously displayed as a single horizontal line on the display screen.

The operation at step ST51 will be described in more detail. When the gradation adjusting function is turned on, the PC1 outputs an analog image signal d1, which is used for displaying the patterns for gradation adjustment over a plurality of pixels on the TFT panel 5, to the preamplifier 10 of the display device 4, and also outputs the automatic adjustment start signal s1 to the CPU3 of the display device 4. Then, the preamplifier 10 changes the signal level of the inputted analog image signal d1 uniformly regardless of the kinds of color signals, and outputs the resulting analog image signal d11 to the ADC2. Here, in the preamplifier 10, since the signal level of the analog image signal d1 is uniformly changed regardless of the kinds of color signals, the analog image signal d11 is also allowed to display the patterns for gradation adjustment.

The ADC2 converts the analog image signal d11, for displaying the inputted patterns for gradation adjustment, to a digital image signal d2, and outputs the resulting signal. Further, the image processing block 6 carries out a predetermined data conversion on the digital image signal d2, and outputs the resulting signal to the TFT panel 5 as a digital image signal d3. On the basis of the digital image signal d3 thus received, the TFT panel 5 displays the patterns for gradation adjustment. In other words, the black pattern and the white pattern are simultaneously displayed line by line. Therefore, the analog image signal d1 and d11 are allowed to have a minimum amplitude value and a maximum amplitude value within one frame period. In other words, the signal levels of the analog image signal d1 and d11 are allowed to have the minimum value and the maximum value within one frame period. Here, on the assumption that the image processing block 6 is included in the TFT panel 5, the TFT panel 5 displays the black pattern and the white pattern on the basis of the digital image signal d2.

Upon receipt of the automatic adjustment start signal s1, the CPU3 starts adjusting processes with respect to the gain value and bias value of the analog image signal d1. More specifically, at step ST52, the CPU3 outputs a gradation adjusting signal s17 to the preamplifier 10 so that the gain value of the analog image signal d1 is set to a minimum value, while the bias value thereof is set to a maximum value. Then, at step ST53, the CPU3 monitors the data of the digital image signal d2 outputted from the ADC2 on a pixel basis during one frame period, and the data corresponding to one frame of the digital image signal d2 thus monitored is compared with the maximum value in the digital output range of the ADC2. Here, since the patterns for gradation adjustment are displayed on the display screen of the TFT panel 5, comparing the data corresponding to one frame of the monitored digital image signal d2 with the maximum value in the digital output range of the ADC2 is consequently equivalent to comparing all the data of the digital image signal d2 corresponding to the patterns for gradation adjustment with the maximum value in the digital output range of the ADC2. It is noted that, since the resolution of the ADC2 is set to 8 bits, the maximum value in the digital output range is set to "255" in the decimal system.

Then, as a result of the comparison at step ST53, of the data corresponding to one frame of the monitored digital image signal d2, when the number of data having the value of "255" is not more than a predetermined threshold value A, the CPU3 sends the gradation adjusting signal s17 to the preamplifier 10 at step ST54 so as to raise the gain value of the analog image signal d1 by one rank. Then, the above-described step ST53 is executed, and of the data corresponding to one frame of the monitored digital image signal d2, when the number of data having the value of "255" is greater than the predetermined threshold value A, the CPU3 fixes the gain value of the analog image signal d1 at that time at step ST55; thus, the adjustment of the gain value is completed.

Next, at step ST56, the CPU3 monitors the data of the digital image signal d2 outputted from the ADC2 on a pixel basis during one frame period, and the data corresponding to one frame of the digital image signal d2 thus monitored is compared with the minimum value in the digital output range of the ADC2. Here, comparing the data corresponding to one frame of the monitored digital image signal d2 with the minimum value in the digital output range of the ADC2 is consequently equivalent to comparing all the data of the digital image signal d2 corresponding to the patterns for gradation adjustment with the minimum value in the digital output range of the ADC2. It is noted that, since the resolution of the ADC2 is set to 8 bits, the maximum value in the digital output range is set to "0" in the decimal system.

Then, as a result of the comparison at step ST56, of the data corresponding to one frame of the monitored digital image signal d2, when the number of data having the value of "0" is not more than a predetermined threshold value B, the CPU3 sends the gradation adjusting signal s17 to the preamplifier 10 at step ST57 so as to lower the bias value of the analog image signal d1 by one rank. Then, the above-described step ST56 is executed, and of the data corresponding to one frame of the monitored digital image signal d2, when the number of data having the value of "0" is greater than the predetermined threshold value B, the CPU3 fixes the bias value of the analog image signal d1 at that time at step S59, and outputs the automatic adjustment completion signal s2 to the PC1. Upon receipt of the automatic adjustment completion signal s2, the PC1 recognizes that the gradation adjustment has been completed in the display device 4, and finishes the display of the patterns for gradation adjustment. More specifically, the PC1 stops the output of the analog image signal d1 that displays the gradation adjusting-use patterns. Here, with respect to the setting method of the threshold values A and B, the same processes as those of the above-described second embodiment are carried out. Therefore, none of description therefor will be given.

By carrying out the gradation adjustment as described above, it becomes possible to make the signal level of the analog image signal d11 coincident with the analog input range of the ADC2. Therefore, it is possible to carry out appropriate gradation display of an image by using a configuration and method different from those of the above-described second embodiment. Consequently, it is possible to supply appropriate image quality to the user.

It is noted that, different from the image quality adjustment carried out by the image display system according to the first embodiment, since it is not necessary for the image display systems according to the second and third embodiments to carry out the image adjusting process each time the PC1 executes an application, the gradation adjustment is carried out, for example, upon activation of the OS. However, the gradation adjustment may be carried out in another timing. Moreover, it is preferable to carry out the gradation adjustments a plurality of times every time a different type of the PC1 is connected. However, in the case of a system without requiring high precision, only one time of the gradation adjustment may be carried out for each PC1.

While the invention has been shown and described in detail, the foregoing description is in all aspects illustrative and not restrictive. It is therefore understood that numerous modifications and variations can be devised without departing from the scope of the invention.

What is claimed is:

1. An image display system comprising:

a computer configured to output a particular analog image signal for displaying a predetermined pattern in a particular frame, and subsequently output analog image signals corresponding to an executed application for displaying images in subsequent frames; and an image display device configured to display images corresponding to the application in the subsequent frames on the basis of said analog image signals corresponding to the application, the image display device further configured to display the predetermined pattern in the particular frame on the basis of the particular analog image signal, wherein said image display device includes:

an analog/digital converter which converts said analog image signals corresponding to the application to digital image signals corresponding to the application, after converting the particular analog image signal to a particular digital image signal;

a display unit which displays the predetermined pattern in the particular frame on the basis of the particular digital image signal, and displays the images corresponding to the application in the subsequent frames on the basis of said digital image signals corresponding to the application; and a controller which carries out a gradation adjustment on the basis of the predetermined pattern by changing a signal level of the particular analog image signal or an analog input range in said analog/digital converter to make a range of signal levels of said predetermined analog image signal coincide with said analog input range, the gradation adjustment being completed before the images corresponding to the application are displayed in the subsequent frames, said particular image signal indicates the predetermined pattern to be displayed over a plurality of pixels for use in said gradation adjustment, and said computer also outputs information for instructing the start of said gradation adjustment to said controller, said information is provided to the image display device separate from the analog image signals corresponding to the application received by the image display device, upon receipt of said information, said controller makes a comparison between all the data of said particular digital image signal and a value included in a digital output range in said analog/digital converter, and carries out said gradation adjustment on the basis of the results of said comparison, and said images corresponding to the application in the subsequent frames are displayed in accordance with the gradation adjustment performed on the basis of the predetermined pattern, wherein the executed application is one of a plurality of applications installed in the computer, the computer outputting the same particular analog image signal regardless of whichever of the plurality of applications is executed.

2. An image display device which is connected to a computer configured to output a particular analog image signal for displaying a predetermined pattern in a particular frame, and subsequently analog image signals corresponding to an executed application for displaying images in subsequent frames, the image display device being configured to display images corresponding to the application in the subsequent frames on the basis of said analog image signals corresponding to the application and further configured to display the predetermined pattern in the particular frame on the basis of the particular analog image signal, the image display device comprising:

an analog/digital converter which converts said analog image signals corresponding to the application to digital image signals, after converting the particular analog image signal to a particular digital image signal;

a display unit which displays the predetermined pattern in the particular frame on the basis of the particular digital image signal, and displays the images corresponding to the application in the subsequent frames on the basis of said digital image signals; and a controller which carries out a gradation adjustment on the basis of the predetermined pattern by changing a signal level of the particular analog image signal or an analog input range in said analog/digital converter to make a range of signal levels of said predetermined analog image signal coincide with said analog input range, the gradation adjustment being completed before the images corresponding to the application are displayed in the subsequent frames, wherein said controller receives said particular analog image signal from the computer, said particular analog image signal indicating the predetermined pattern to be displayed over a plurality of pixels for use in said gradation adjustment, and also receives information from the computer for instructing the start of said gradation adjustment, upon receipt of said information, the controller makes a comparison between all the data of said particular digital image signal and a value included in a digital output range in said analog/digital converter, and carries out said gradation adjustment on the basis of the results of said comparison, said information is provided to the image display device separate from the analog image signals corresponding to the application received by the image display device, and said display unit displays said images corresponding to the application in the subsequent frames in accordance with the gradation adjustment performed on the basis of the predetermined pattern, wherein the executed application is one of a plurality of applications installed in the computer, the image display unit displaying the same predetermined pattern regardless of whichever of the plurality of applications is executed by the computer.

* * * * *